US007284293B1

(12) United States Patent
Holder et al.

(10) Patent No.: US 7,284,293 B1
(45) Date of Patent: Oct. 23, 2007

(54) ARTICLE AND METHOD FOR CLEANING UNEVEN, VARIABLE GEOMETRY SURFACES OF ELECTRONIC DEVICES, INTERNAL ELECTRONIC ASSEMBLIES, OR THE LIKE

(75) Inventors: Helen A. Holder, Sunnyvale, CA (US); Sandra G. Goebel, Menlo Park, CA (US); William H. Leong, San Mateo, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 248 days.

(21) Appl. No.: 10/172,529

(22) Filed: Jun. 14, 2002

(51) Int. Cl.
*A46B 9/02* (2006.01)
*A47L 13/10* (2006.01)
*A47L 13/17* (2006.01)
*B08B 11/00* (2006.01)

(52) U.S. Cl. ..... 15/104.94; 15/160; 15/210.1; 15/227; 15/244.1; 15/DIG. 5

(58) Field of Classification Search ..... 15/104.94, 15/209.1, 210.1, 244.1, 244.2, 244.3, 244.4, 15/DIG. 5, 187, 188, 160, 227; D32/40
See application file for complete search history.

(56) References Cited

U.S. PATENT DOCUMENTS 2,946,074 A * 7/1960 Caldwell ..... 401/19
3,312,583 A * 4/1967 Rochlis ..... 428/88
3,651,530 A 3/1972 Schultz
3,744,078 A * 7/1973 Vallis ..... 15/167.3
3,843,991 A * 10/1974 Vallis ..... 15/167.3
4,077,725 A * 3/1978 Slautterback ..... 401/17
4,083,078 A * 4/1978 Shimizu ..... 15/244.1
4,211,247 A 7/1980 Morganroth
4,325,392 A * 4/1982 Iten et al. ..... 132/289
4,480,351 A * 11/1984 Koffler ..... 15/187
4,866,806 A * 9/1989 Bedford ..... 15/104.94
4,886,078 A * 12/1989 Shiffman ..... 132/73
4,975,999 A * 12/1990 Levy ..... 15/210.1
5,378,226 A 1/1995 Hanifl et al.
5,664,278 A * 9/1997 Reisman ..... 15/160
5,709,866 A 1/1998 Booras et al.
5,771,522 A 6/1998 Carmody
5,806,135 A * 9/1998 Earle ..... 15/244.4
5,822,826 A * 10/1998 Parker ..... 15/244.4
5,836,034 A * 11/1998 Galvan Garza ..... 15/118
5,985,042 A 11/1999 Fiedler
6,035,476 A * 3/2000 Underwood et al. ..... 15/22.1
6,132,841 A * 10/2000 Guthrie et al. ..... 428/132
6,182,323 B1 2/2001 Bahten
6,185,778 B1 2/2001 Ornstedt
D439,414 S 3/2001 Birdwell
6,210,060 B1 * 4/2001 Gueret ..... 401/129
6,212,726 B1 4/2001 Naghi et al.
6,298,515 B1 10/2001 Robinson
6,374,449 B1 * 4/2002 Jolly ..... 15/161
6,810,553 B1 * 11/2004 Otsuji et al. ..... 15/227
2003/0108846 A1 * 6/2003 Hoertsch ..... 433/216

* cited by examiner

*Primary Examiner*—Randall Chin

(57) ABSTRACT

This disclosure relates to an article for cleaning uneven, variable geometry surfaces of electronic devices, internal electronic assemblies, or the like. The article comprises a housing having opposing faces with a support mounted to a first of the faces and a cleaning surface mounted to a second and opposite face of the housing. The cleaning surface includes a substantially flexible material formed in multiple, alternating patterns comprising at least one row of non-continuous, relatively tall triangular-like spikes separated by a plurality of rows of continuous, relatively short triangular-like spikes. Upon grasping of the support by a user, pressing the cleaning surface into contact with a surface to be cleaned, and moving the article along and against the surface, the relatively tall triangular-like spikes engage generally low portions of the surface, whereas the relatively short triangular-like spikes engage generally higher portions of the surface so as to remove dirt and debris from the low to the high portions of the surface, respectively.

24 Claims, 11 Drawing Sheets

ARTICLE AND METHOD FOR CLEANING UNEVEN, VARIABLE GEOMETRY SURFACES OF ELECTRONIC DEVICES, INTERNAL ELECTRONIC ASSEMBLIES, OR THE LIKE

FIELD OF THE INVENTION

The present invention relates generally to cleaning and purification and, more particularly, to an article and a method for cleaning, disinfecting and/or static neutralization of uneven surfaces, removing impurities, loosening and removing debris, or the like.

BACKGROUND OF THE INVENTION

For thousands of years, a multitude of different methods, devices, chemicals and apparatus have been employed in an effort to clean uneven and irregularly shaped surfaces, cracks, crevices, indentations and the like. These approaches have ranged from the primitive, e.g., wetting a leaf or a user's hand with saliva or water and rubbing or wiping away dirt, to using rags, wipes, swabs or scrub brushes, with or without water, ammonia or alcohol based solutions, to clean the surface. The objective has been to provide a single article (or method) for rapid, effective cleaning, disinfection and/or purification of virtually any surface geometry, whether characterized by rounded or squared surfaces, peaks and valleys, cracks and crevices or the like.

While such approaches have been useful, limited progress has been made in surface cleaning, namely, providing an article and a method that is not only economical and relatively effortless to use, but is also effective and not damaging the surface. To compound this challenge, detailed, unusually shaped, man-made surfaces have erected new barriers and added to the complexity of cleaning uneven surfaces.

Perhaps the best known item for cleaning uneven surfaces and variable geometries is the conventional bristled brush, which is moved back and forth against the surface desired to be cleaned. While relatively effective and reliable for some surfaces, particularly those of relatively small variation in height and depth, irregular surface geometries and the physical and dimensional restrictions posed by bristles have limited the effectiveness of brushes for cleaning electronic devices. In addition, the abrasive qualities of bristles (whether plastic or organically based) have often been found damaging to materials typically used in the construction of electronic devices such as molded plastics, laminated surfaces, brushed metallic surfaces and decals. Furthermore, shedding characteristics of most bristles are not only annoying to the user, but can also necessitate an additional cleaning step.

In an attempt to avoid surface abrasion and shedding, sponges have also been utilized. While generally effective for bringing cleaning solutions into contact with the surface to be cleaned, sponges usually provide little or no scouring effect, nor are they suitable for reaching into, and removing debris from, cracks, crevices and surface valleys. Furthermore, their superior ability to retain fluids often allows excessive amounts of cleaning solution to leak onto surfaces of electronic devices and, in turn, come into contact with the sensitive electronics below.

More recently, specialized wipes and swabs have been developed for cleaning electronics. They often include cotton or a polymeric based fiber material soaked in alcohol or like antistatic solution. Wipes, e.g., those sold under the name Fellowes Computerware® or The Texwipe Company, are encased with a selected volume of solution in an airtight dispenser or sealed packet, and dispensed for one-time disposable use. Similarly, and perhaps the most long standing approach is the use of a cotton rag dipped in water, alcohol or an ammonia-based solution to cleanse, disinfect and/or neutralize static electricity on surfaces of electronic devices.

Although wipes and rags have proven helpful for cleaning with little abrasion, their flat wiping surface is unsuitable for many variable geometry surfaces, at least without the user expending much time, skill and effort. In this connection, the user must frequently use his/her muscle, fingernails, and ingenuity to shape, twist and bend the wipe/rag into a configuration suitable for cleaning various surface shapes and depths. Rags are readily washed and reused, but their use with water is considered undesirable for cleaning and potentially damaging to sensitive electronics often located below the surfaces being cleaned. Hence, specialized solutions are needed to insure their effectiveness. As for wipes and swabs, they have been found impractical and time consuming for cleaning large surface areas, are generally suitable for one-time use only, and require specialized chemicals for effective dirt removal. The user must also purchase a new supply when he or she runs out, making wipes and swabs an expensive, inconvenient and cumbersome option.

In an effort to eliminate these drawbacks, pressurized gas, air or the like has also been used to blow dirt and debris from oddly shaped, complex surfaces. For instance, Dritz® Precision Duster III, a product of Prym-Dritz Corporation, provides a canister containing a liquid/gas mixture stored under pressure that is selectively emitted from a flexible, narrow tube. For removing dust and loose debris from keyboards and ventilation grills of computers, which are known for their numerous crevices and other difficult to clean surfaces, high velocity gas has been found relatively effective. Similarly, battery powered, rechargeable, and/or AC vacuum devices have been employed to draw away dirt and debris. Economic considerations and practical restrictions in the respective gas velocities and suction that may be delivered, however, as well as their limited scouring effect has made them useful for little more than dust removal.

More recently, relatively soft bristled brushes, e.g., toothbrushes, with variable length bristle patterns have been developed for cleaning uneven surfaces. Tooth sponges in wavy patterns have also been provided for this purpose. While beneficial for cleaning plaque from rounded tooth surfaces and between teeth, these cleaning arrangements, in being designed specifically for teeth, are non-versatile, having been found generally unfit for application to the unique geometries, surface characteristics and dirt associated with electronic devices. Moreover, these brushes are designed for use in conjunction with cleaning compositions that are pasty, abrasive and difficult to remove without flushing the surfaces being cleaned with water. In the case of tooth sponges, leakage of fluid and their ineffectiveness for cleaning in cracks and crevices has likewise made them highly untenable.

An article and a method are, therefore, desired that not only effectively clean, disinfect and/or neutralize static on uneven, variable geometry surfaces, but also allow surface cleansing to be done simply, economically, and relatively effortlessly.

OBJECTS AND SUMMARY OF THE INVENTION

According to one aspect of the present invention, there is provided an article for cleaning uneven, variable geometry surfaces of electronic devices, internal electronic assemblies or the like. The article comprises a housing having opposing faces with a support mounted to a first of the faces and a cleaning surface mounted to a second and opposite face of the housing. The cleaning surface includes a substantially flexible material formed in multiple, alternating patterns comprising at least one row of non-continuous, relatively tall triangular-like spikes separated by a plurality of rows of continuous, relatively short triangular-like spikes. Upon grasping of the support by a user, pressing the cleaning surface into contact with a surface to be cleaned, and moving the article along and against the surface, the relatively tall triangular-like spikes engage generally low portions of the surface, whereas the relatively short triangular-like spikes engage generally higher portions of the surface so as to remove dirt and debris from the low to the high portions of the surface, respectively.

In accordance with another aspect of the present invention is an article for cleaning uneven, variable geometry surfaces of electronic devices, internal electronic assemblies or the like. The article comprises a housing having opposing faces with a support mounted to a first of the faces and a cleaning surface mounted to a second and opposite face of the housing. The cleaning surface includes a substantially flexible material formed in multiple, alternating patterns comprising at least one row of non-continuous, relatively tall triangular-like spikes separated by a plurality of rows of continuous, relatively short triangular-like spikes. In at least one column of the non-continuous, relatively tall spikes, the spikes are interspersed with and separated by a corresponding column comprising a plurality of continuous, relatively short triangular-like spikes. Upon grasping of the support by a user, pressing the cleaning surface into contact with a surface to be cleaned, and moving the article along and against the surface, the relatively tall triangular-like spikes engage generally low portions of the surface, whereas the relatively short triangular-like spikes engage generally higher portions of the surface so as to remove dirt and debris from the low to the high portions of the surface, respectively.

According to a further aspect of the present invention, an article is provided for cleaning uneven, variable geometry surfaces of electronic devices, internal electronic assemblies or the like. The article comprises a housing having opposing faces with a support mounted to a first of the faces and a cleaning surface mounted to a second and opposite face of the housing. The cleaning surface includes a plurality of clumps of relatively soft, thin, flexible, vertically disposed fibers, the fibers being grouped in multiple, alternating patterns comprising at least one row of non-continuous, relatively tall fiber clumps, the tall fiber clumps including fibers of variable height arranged so as to form a triangular-like spike and the tall fiber clumps being separated by a plurality of rows of continuous, relatively short fiber clumps, the short fiber clumps including fibers of variable height arranged so as to likewise form a triangular-like spike. Upon grasping of the support by a user, pressing the cleaning surface into contact with a surface to be cleaned, and moving the article along and against the surface, the relatively tall fiber clumps engage generally low portions of the surface, whereas the relatively short fiber clumps engage generally higher portions of the surface so as to remove dirt and debris from the low to the high portions of the surface, respectively.

In accordance with yet another aspect of the present invention, an article is provided for cleaning uneven, variable geometry surfaces of electronic devices, internal electronic assemblies or the like. The article comprises a housing having opposing faces with a support mounted to a first of the faces and a cleaning surface mounted to a second and opposite face of the housing. The cleaning surface includes a plurality of relatively soft, thin, flexible, vertically disposed fibers, the fibers being grouped in multiple, alternating patterns comprising at least one row of non-continuous, relatively tall fiber clumps, the tall fiber clumps including fibers of variable height arranged so as to form a triangular-like spike and the tall fiber clumps being separated by a plurality of rows of continuous, relatively short fiber clumps, the short fiber clumps including fibers of variable height arranged so as to likewise form a triangular-like spike. In at least one column of the non-continuous, relatively tall fiber clumps, the spikes are interspersed with and separated by a corresponding column comprising a plurality of continuous, relatively short fiber clumps. Upon grasping of the support by a user, pressing the cleaning surface into contact with a surface to be cleaned, and moving the article along and against the surface, the relatively tall fiber clumps engage generally low portions of the surface, whereas the relatively short fiber clumps engage generally higher portions of the surface so as to remove dirt and debris from the low to the high portions of the surface, respectively.

According to still another aspect of the present invention is an article for cleaning uneven, variable geometry surfaces of electronic devices, internal electronic assemblies or the like. The article comprises a base having opposing faces with a handle mounted to a first of the faces and a cleaning surface mounted to a second and opposite face of the base. The cleaning surface includes a substantially flexible material formed in multiple, alternating patterns comprising at least one row of continuous, relatively tall teeth separated by a plurality of rows of continuous, relatively short teeth. Upon grasping of the handle by a user, pressing the cleaning surface into contact with a surface to be cleaned, and moving the article along and against the surface, the relatively tall teeth engage generally low portions of the surface, whereas the relatively short teeth engage generally higher portions of the surface so as to remove dirt and debris from the low to the high portions of the surface, respectively.

In accordance with yet a further aspect of the present invention is an article for cleaning uneven, variable geometry surfaces of electronic devices, internal electronic assemblies or the like. The article comprises a base having opposing faces with a handle mounted to a first of the faces and a cleaning surface mounted to a second and opposite face of the base. The cleaning surface includes a substantially flexible material formed in multiple, alternating patterns comprising at least one row of non-continuous, relatively tall teeth separated by a plurality of rows of continuous, relatively short teeth. In at least one column of the non-continuous, relatively tall teeth, the teeth are interspersed with and separated by a corresponding column comprising a plurality of continuous, relatively short teeth. Upon grasping of the handle by a user, pressing the cleaning surface into contact with a surface to be cleaned, and moving the article along and against the surface, the relatively tall teeth engage generally low portions of the surface, whereas the relatively short teeth engage generally higher portions of the surface so as to remove dirt and debris from the low to the high portions of the surface, respectively.

According to yet a further aspect of the present invention, an article is provided for cleaning uneven, variable geometry surfaces of electronic devices, internal electronic assemblies or the like. The article comprises a base having opposing faces with a handle mounted to a first of the faces and a cleaning surface mounted to a second and opposite face of the base. The cleaning surface includes a plurality of clumps of relatively soft, thin, flexible, vertically disposed fibers, the fibers being grouped in multiple, alternating patterns comprising at least one row of continuous, relatively tall fiber clumps, each of the tall fiber clumps including fibers of variable height arranged in the form a tooth and the tall fiber clumps being separated by a plurality of rows of continuous, relatively short fiber clumps, each of the short fiber clumps including fibers of variable height arranged so as to likewise form a tooth. Upon grasping of the handle by a user, pressing the cleaning surface into contact with a surface to be cleaned, and moving the article along and against the surface, the relatively tall fiber clumps engage generally low portions of the surface, whereas the relatively short fiber clumps engage generally higher portions of the surface so as to remove dirt and debris from the low to the high portions of the surface, respectively.

In accordance with still a further aspect of the present invention, an article is provided for cleaning uneven, variable geometry surfaces of electronic devices, internal electronic assemblies or the like. The article comprises a base having opposing faces with a handle mounted to a first of the faces and a cleaning surface mounted to a second and opposite face of the base. The cleaning surface includes a plurality of relatively soft, thin, flexible, vertically disposed fibers, the fibers being grouped in multiple, alternating patterns comprising at least one row of non-continuous, relatively tall fiber clumps, each of the tall fiber clumps including fibers of variable height arranged so as to form a tooth and the tall fiber clumps being separated by a plurality of rows of continuous, relatively short fiber clumps, each of the short fiber clumps including fibers of variable height arranged so as to likewise form a tooth. In at least one column of the non-continuous, relatively tall fiber clumps, the teeth are interspersed with and separated by a corresponding column comprising a plurality of continuous, relatively short fiber clumps. Upon grasping of the handle by a user, pressing the cleaning surface into contact with a surface to be cleaned, and moving the article along and against the surface, the relatively tall fiber clumps engage generally low portions of the surface, whereas the relatively short fiber clumps engage generally higher portions of the surface so as to remove dirt and debris from the low to the high portions of the surface, respectively.

According to another aspect of the present invention, an article is provided for cleaning uneven, variable geometry surfaces of electronic devices, internal electronic assemblies or the like. The article comprises a housing having opposing faces with a support mounted to a first of the faces and a cleaning surface mounted to a second and opposite face of the housing. The cleaning surface includes a substantially flexible material formed in multiple, alternating patterns of relatively tall triangular-like spikes and relatively short triangular-like spikes. Upon grasping of the support by a user, pressing the cleaning surface into contact with a surface to be cleaned, and moving the article along and against the surface, the relatively tall triangular-like spikes engage generally low portions of the surface, whereas the relatively short triangular-like spikes engage generally higher portions of the surface so as to remove dirt and debris from the low to the high portions of the surface, respectively.

In accordance with yet another aspect of the present invention is an article for cleaning uneven, variable geometry surfaces of electronic devices, internal electronic assemblies or the like. The article comprises a base having opposing faces with a handle mounted to a first of the faces and a cleaning surface mounted to a second and opposite face of the base. The cleaning surface includes a substantially flexible material formed in multiple, alternating patterns of relatively tall teeth and relatively short teeth. Upon grasping of the handle by a user, pressing the cleaning surface into contact with a surface to be cleaned, and moving the article along and against the surface, the relatively tall teeth engage generally low portions of the surface, whereas the relatively short teeth engage generally higher portions of the surface so as to remove dirt and debris from the low to the high portions of the surface, respectively.

According to a further aspect of the present invention, an article is provided for cleaning uneven, variable geometry surfaces of electronic devices internal electronic assemblies or the like. The article comprises a housing having opposing faces with a support mounted to a first of the faces and a cleaning surface mounted to a second and opposite face of the housing. The cleaning surface includes a substantially flexible material formed in rows of pyramid-like teeth. Upon grasping of the support by a user, pressing the cleaning surface into contact with a surface to be cleaned, and moving the article along and against the surface, the flexibility and configuration of the teeth being such as to engage both relatively low portions of the surface and relatively high portions of the surface so as to remove dirt and debris from the low to the high portions of the surface.

According to a further aspect of the present invention, there is provided a method of cleaning uneven, variable geometry surfaces of electronic devices, internal electronic assemblies or the like. Initially, a support of an article is grasped by a user, the article comprising a housing having opposing faces with a support mounted to a first of the faces and a cleaning surface mounted to a second and opposite face of the housing. The cleaning surface includes a substantially flexible material formed in multiple, alternating patterns comprising at least one row of non-continuous, relatively tall teeth separated by a plurality of rows of continuous, relatively short teeth. Next, the cleaning surface of the article is pressed into contact with a surface to be cleaned. The article is then moved along and against the surface, the relatively tall teeth engaging generally low portions of the surface, and the relatively short teeth engaging generally higher portions of the surface so as to remove dirt and debris from the low to the high portions of the surface, respectively.

According to another aspect of the present invention, a method is provided for cleaning uneven, variable geometry surfaces of electronic devices, internal electronic assemblies or the like. First, a support of an article is grasped by a user, the article comprising a housing having opposing faces with a support mounted to a first of the faces and a cleaning surface mounted to a second and opposite face of the housing. The cleaning surface includes a plurality of clumps of relatively soft, thin, flexible, vertically disposed fibers, the fibers being grouped in multiple, alternating patterns comprising at least one row of non-continuous, relatively tall fiber clumps, each of the tall fiber clumps including fibers of variable height arranged in the form a tooth and the tall fiber clumps being separated by a plurality of rows of continuous, relatively short fiber clumps, each of the short fiber clumps including fibers of variable height arranged so as to likewise form a tooth. Next, the cleaning surface of the article is pressed into contact with a surface to be cleaned. The article is then moved along and against the surface, the relatively tall fiber clumps engaging generally low portions of the surface, and the relatively short fiber clumps engaging generally higher portions of the surface so as to remove dirt and debris from the low to the high portions of the surface, respectively.

According to another aspect of the present invention, a method is provided for cleaning uneven, variable geometry surfaces of electronic devices, internal electronic assemblies or the like. First, a support of an article is grasped by a user, the article comprising a housing having opposing faces with a support mounted to a first of the faces and a cleaning surface mounted to a second and opposite face of the housing. The cleaning surface includes a substantially flexible material formed in multiple, alternating patterns of relatively tall triangular-like spikes and relatively short triangular-like spikes. Next, the cleaning surface of the article is pressed into contact with a surface to be cleaned. The article is then moved along and against the surface, the relatively tall triangular-like spikes engaging generally low portions of the surface, and the relatively short triangular-like spikes engaging generally higher portions of the surface so as to remove dirt and debris from the low to the high portions of the surface, respectively.

According to a still further aspect of the present invention, a method is provided for cleaning uneven, variable geometry surfaces of electronic devices, internal electronic assemblies or the like. A support of an article is grasped by a user, the article comprising a housing having opposing faces with a support mounted to a first of the faces and a cleaning surface mounted to a second and opposite face of the housing. The cleaning surface includes a substantially flexible material formed in rows of pyramid-like teeth. Next, the cleaning surface of the article is pressed into contact with a surface to be cleaned. The article is then moved along and against the surface, the flexibility and configuration of the teeth being such as to engage both relatively low portions of the surface and relatively high portions of the surface so as to remove dirt and debris from the low to the high portions of the surface.

It is, therefore, an object of the present invention to provide an improved article and method for cleaning uneven, variable geometry surfaces of electronic devices, internal electronic assemblies or the like.

Another object of the present invention is to provide a battery free, non-electric, reusable article specially tailored for manually cleaning uneven, variable geometry surfaces of electronic devices, internal electronic assemblies or the like.

A further object of the present invention is to provide an article for cleaning uneven, variable geometry surfaces of electronic devices, internal electronic assemblies or the like which has a design life considerably longer than that of a traditional brushes, sponges, cloths and/or wipes.

Still another object of the present invention is to provide a practical, lightweight article for cleaning uneven, variable geometry surfaces of electronic devices, internal electronic assemblies or the like that is safe for any surface, durable and reliable.

Yet another object of the present invention is to provide an article for cleaning uneven, variable geometry surfaces of electronic devices, internal electronic assemblies or the like that readily fits any a user's hand.

Still a further object of the present invention is to provide an article and a method that effectively cleans virtually any uneven, variable geometry, exterior surface of electronic devices, internal electronic assemblies or the like with minimal skill and vigilance of the user.

Yet a further object of the present invention is to provide an improved article constructed of low cost materials for cleaning uneven, variable geometry surfaces of electronic devices, internal electronic assemblies or the like.

Another object of the present invention is to provide an improved article and a method for cleaning uneven, variable geometry surfaces of electronic devices, internal electronic assemblies or the like that is adaptable for use with or without specialized chemicals for enhanced cleaning, disinfection and/or neutralizing static.

A further object of the present invention is to provide an article for cleaning uneven, variable geometry surfaces of electronic devices, internal electronic assemblies or the like that is easy to store, practical for a traveler and requires no adapter, re-charger or the like.

Still another object of the present invention is to provide an article and a method for cleaning uneven, variable geometry surfaces of electronic devices, internal electronic assemblies or the like that is quiet and efficient in operation.

Yet another object of the present invention is to provide a relatively small and readily maneuverable article with gentle brushing, rubbing and/or scouring action for cleaning uneven, variable geometry surfaces of electronic devices, internal electronic assemblies or the like.

Still a further object of the present invention is to provide an article and a method for cleaning uneven, variable geometry surfaces of electronic devices, internal electronic assemblies or the like using variable levels of bristles, flexible teeth or other specially configured arrangements adapted for cleaning different height surfaces, irregularly shaped surfaces and for penetrating grooves, crevices or the like.

Yet a further object of the present invention is to provide an improved article and a method for cleaning difficult to remove residues from uneven, variable geometry surfaces of electronic devices such as computer mice, remote controls, keyboards, joysticks or the like.

Another object of the present invention is to provide a practical, economical article that is better adapted for cleaning the uneven, variable geometry surfaces of handheld electronic devices, internal electronic assemblies or the like than conventional wipes and rags, provides superior scouring effect as compared to sponges and pressurized air, is larger and faster to use than swabs, provides a softer and more versatile cleaning surface than conventional brushes for gentle cleaning and is more economical than vacuum devices.

Still another object of the present invention is to provide an article and a method that provides rapid, effective cleaning, disinfection, purification and/or static neutralization of virtually any surface geometry, whether characterized by rounded or squared surfaces, peaks and valleys, cracks and crevices or the like.

Yet another object of the present invention is to provide an article and a method that is uniquely well-suited for cleaning detailed, unusually shaped, man-made surfaces.

A further object of the present invention is to provide a brush and method for cleaning uneven, variable geometry surfaces of electronic devices, internal electronic assemblies or the like that provides gentle brushing action without cleaning surface abrasion or shedding.

Still a further object of the present invention is to provide a fast, practical and reusable article for cleaning uneven, variable geometry surfaces of electronic devices, internal electronic assemblies or the like, that is durable, versatile, economical and easy to use.

The present invention will now be further described by reference to the following drawings which are not intended to limit the accompanying claims.

BRIEF DESCRIPTION OF THE DRAWINGS

The same numerals are used throughout the figure drawings to designate similar elements. Still other objects and advantages of the present invention will become apparent from the following description of the preferred embodiments.

DETAILED DESCRIPTION OF THE PREFERRED EMBODIMENTS

Figure 1:
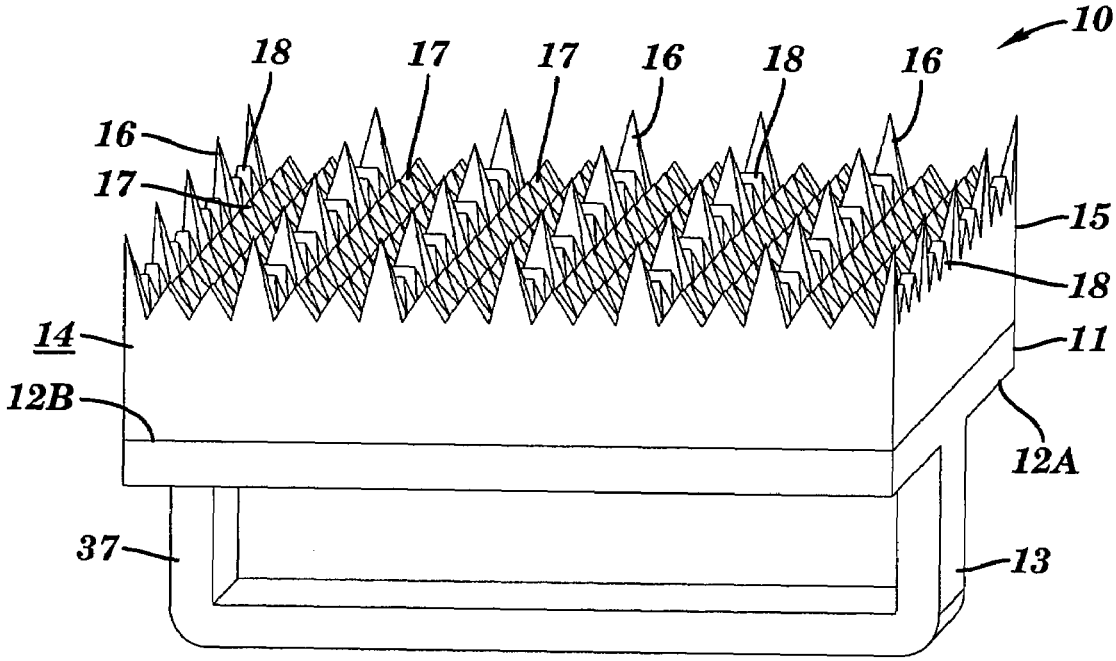
FIG. 1 is a perspective view of an article for cleaning uneven, variable geometry surfaces of electronic devices, internal electronic assemblies, or the like, according to one aspect of the present invention.
Figure 2:
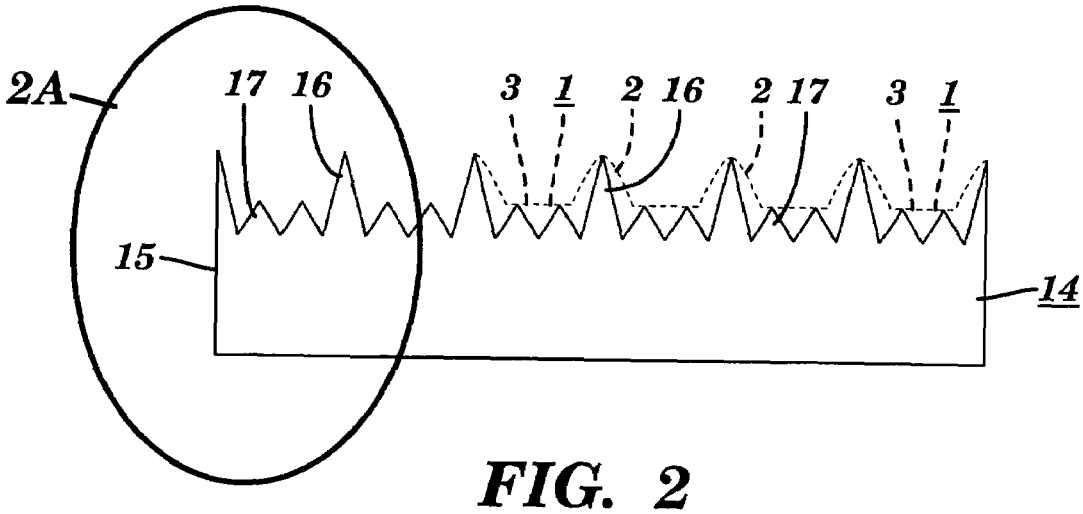
FIG. 2 is an side view of the article cleaning surface shown in FIG. 1 with an illustrative keyboard type cleaning surface shown in dashed lines.
Figure 2A:
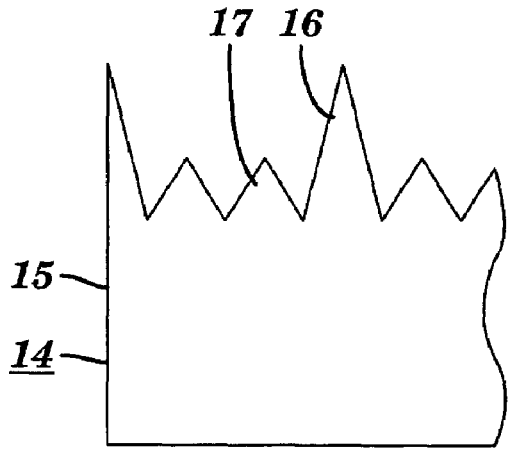
FIG. 2A is an enlarged cut-away view of the article shown in FIG. 2 showing a tooth configuration, according to one aspect of the present invention.
Figure 2B:
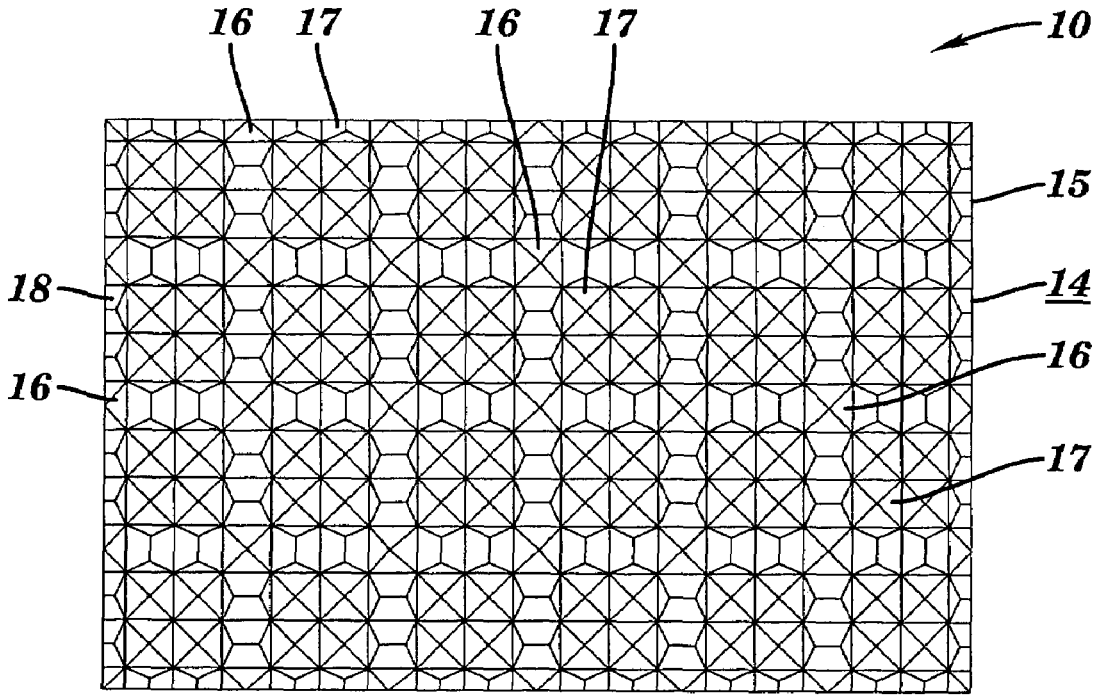
FIG. 2B is a top plan view of the article shown in FIG. 2.

Referring now to the drawings and more particularly to FIGS. 1-13, there is shown generally a specific, illustrative, article 10 for cleaning uneven, variable geometry surfaces 1 of electronic devices, internal electronic assemblies, or the like, according to various aspects of the present invention. According to one aspect of the present invention, as shown in FIGS. 1-2B, the article has a housing 11 such as a rectangular polymeric block with opposing faces 12*a*, 12*b*. A support 13 is mounted to the first of the housing faces 12*a*, and a cleaning surface 14 is mounted to the second and opposite face 12*b*.

The cleaning surface includes a substantially flexible material 15, e.g., ESD polyurethane, formed in multiple, alternating patterns comprising at least one row of non-continuous, relatively tall triangular-like spikes 16, e.g., up to about 15 mm, separated by a plurality of rows of continuous, relatively short triangular-like spikes 17, e.g., up to about 5 mm. An objective of this material is to provide an effective but non-abrasive, inexpensive, light weight material for cleaning, static neutralization and/or disinfection with enhanced durability and performance.

Upon grasping of the support by a user, pressing the cleaning surface into contact with a surface to be cleaned, and moving the article along and against surface 1, such being shown by dashed lines in FIG. 2, the relatively tall triangular-like spikes engage generally low portions 2 of the surface and, more or less concurrently therewith, the relatively short triangular-like spikes engage generally higher portions 3 of the surface so as to remove dirt and debris from the lowest to the highest portions of the surface, respectively. Selected portions of the tall and short spikes, depending on the manner of operation, engage relatively even portions of the surface as well as generally medium height portions in order to insure coverage, as practicable, of the surface.

Alternatively or concurrently, as best seen in FIG. 1, in at least one column of the non-continuous, relatively tall spikes, the spikes are interspersed with and separated by a corresponding column comprising a plurality of the continuous, relatively short triangular-like spikes 18. This arrangement provides added coverage of corresponding, closely spaced high and low portions of the surface. It has not only been found highly effective for removing debris from cracks, crevices and other irregular, uneven surfaces, but also for cleaning variable shaped geometries and between the peaks and valleys characteristic of many irregularly shaped surfaces.

Suitable housing dimensions include, but are not limited to, a length of about 90 mm and a width of approximately 60 mm, the depth of the flexible material being roughly 25 mm measured from the highest spike to the base of the material. Preferred corresponding dimensions of tall spikes, measured from the base of the spike to its peak, is about 10 mm, and short spikes, also determined from the base of the spike to its peak, is approximately 4.25 mm, the height of the respective tall and short spikes being in a ratio of 2:1. Furthermore, an exemplary peak to peak distance between neighboring tall and short spikes, or short and short spikes, is desirably about 5 mm.

Figure 3:
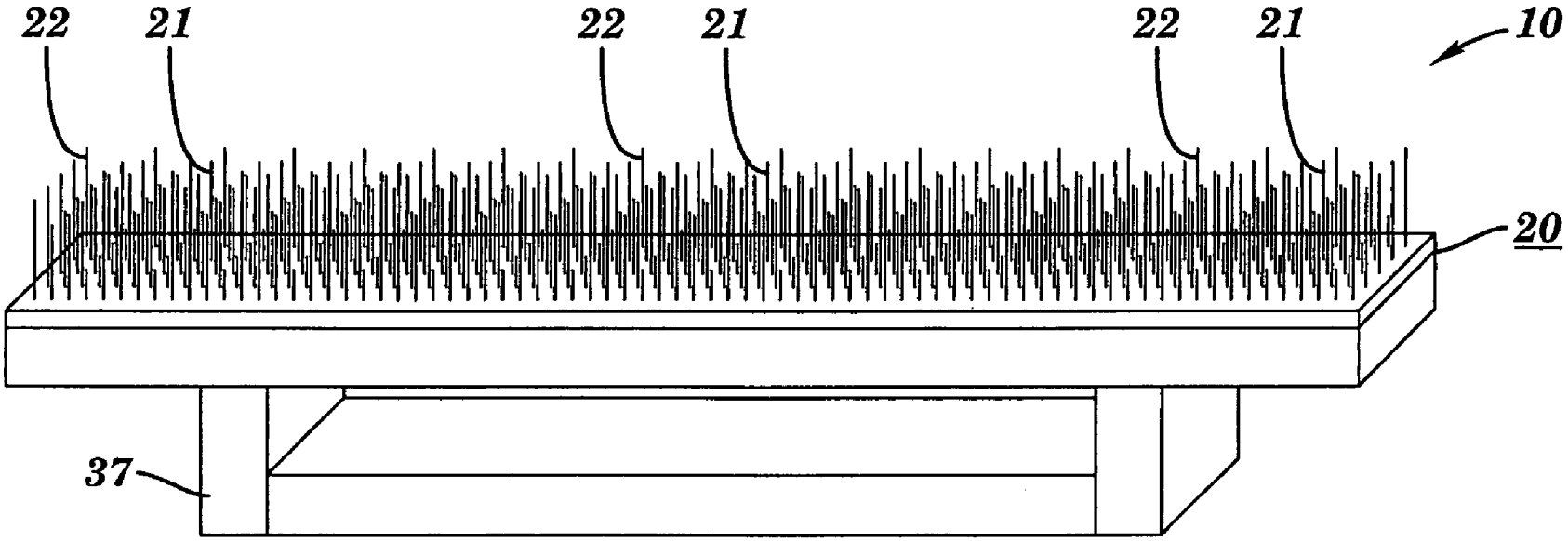
FIG. 3 is a perspective view of an article for cleaning uneven, variable geometry surfaces of electronic devices, internal electronic assemblies, or the like in accordance with another aspect of the present invention.
Figure 4:
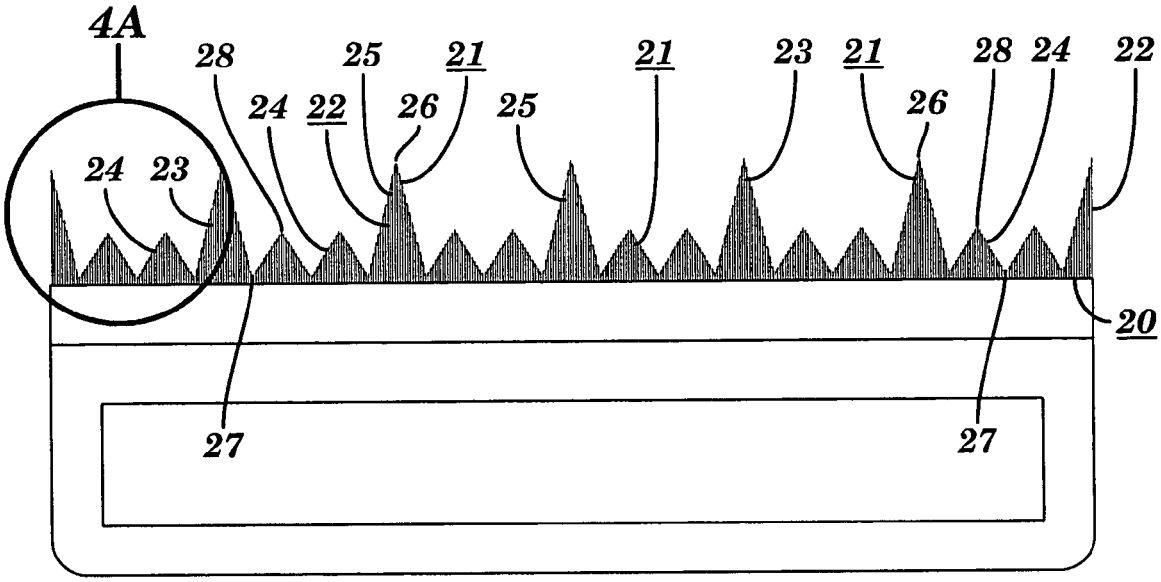
FIG. 4 is an side view of the article shown in FIG. 3.
Figure 4A:
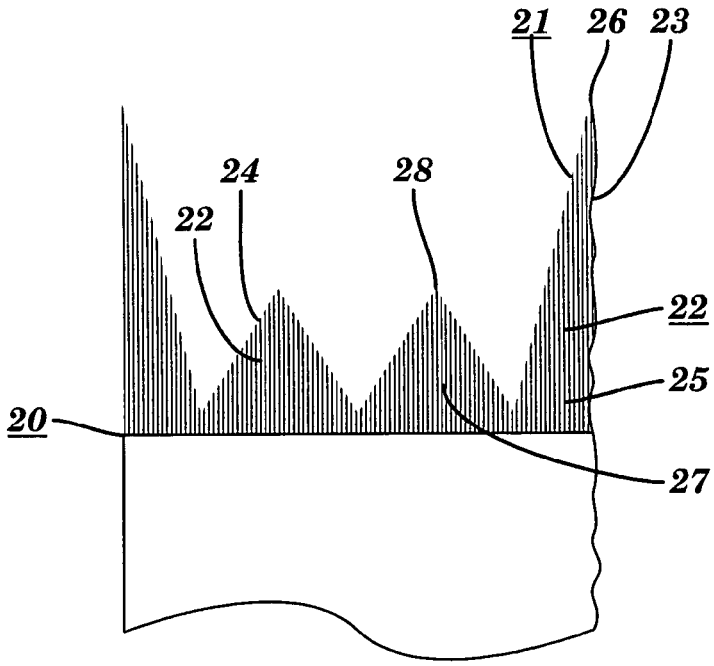
FIG. 4A is an enlarged cut-away view of the article shown in FIG. 4 showing a tooth configuration, according to one aspect of the present invention.
Figure 5:
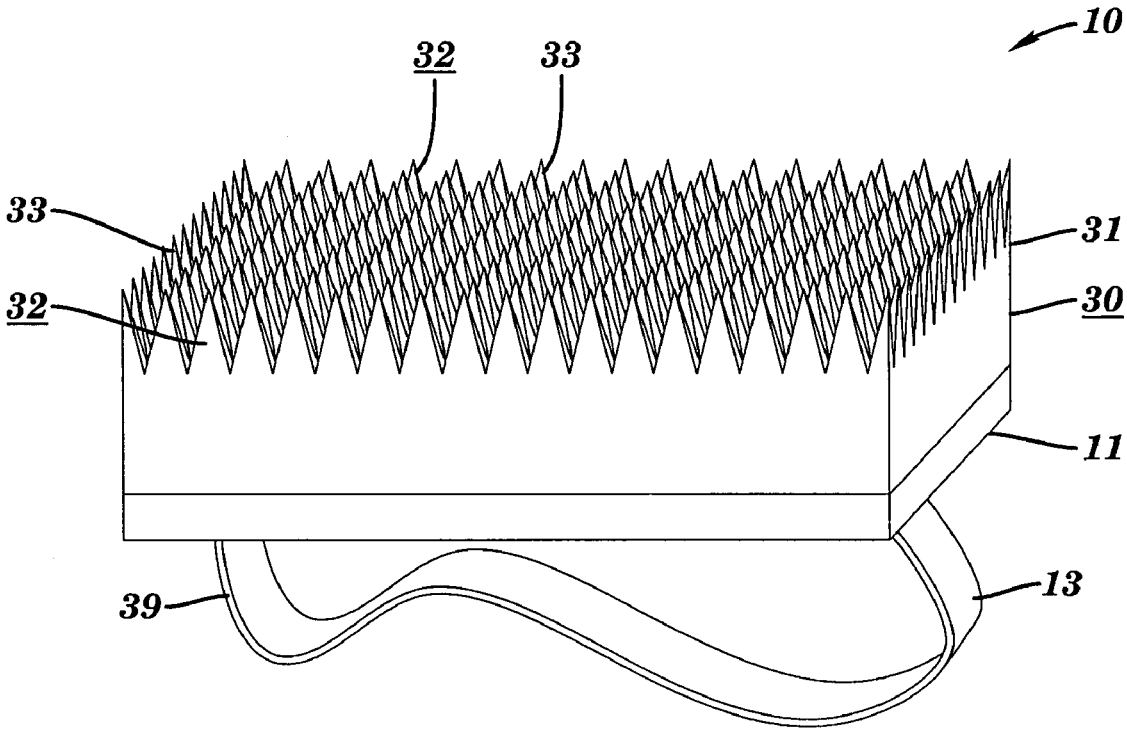
FIG. 5 is a perspective view of an article for cleaning uneven, variable geometry surfaces of electronic devices, internal electronic assemblies, or the like, according to a further aspect of the present invention.
Figure 6:
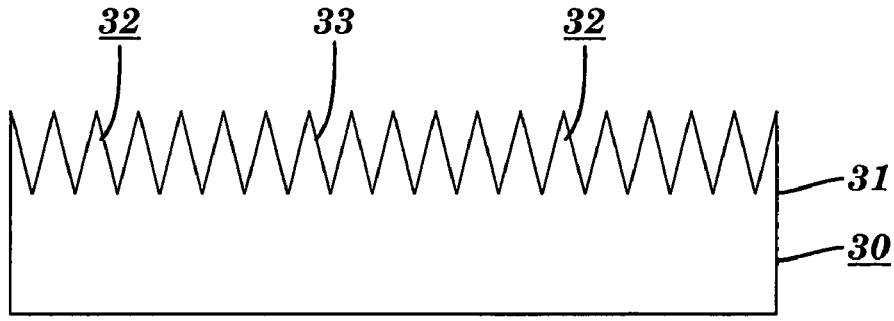
FIG. 6 is an side view of the article shown in FIG. 5.
Figure 6A:
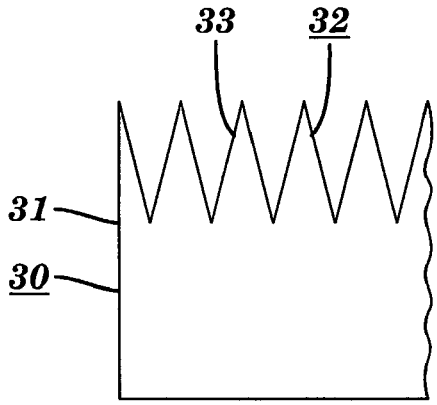
FIG. 6A is an enlarged cut-away view of the article shown in FIG. 6 showing a tooth configuration, according to one aspect of the present invention.
Figure 7:
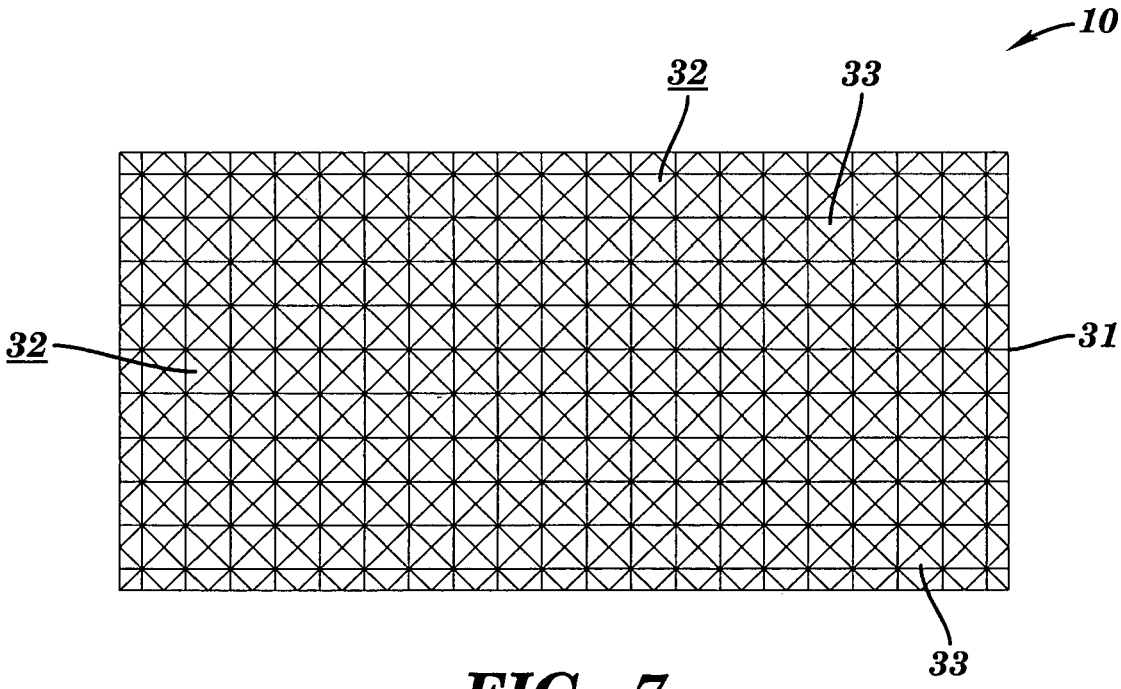
FIG. 7 is a top plan view of the article shown in FIG. 5.

In another embodiment, an article cleaning surface 20 is provided that includes a plurality of clumps 21 of relatively soft, thin, flexible, vertically disposed fibers 22 grouped in multiple, alternating patterns. A cleaning surface of this general description is illustrated in FIGS. 3-4A. Preferably, the pattern comprises at least one row of non-continuous, relatively tall fiber clumps 23, e.g, up to about 15 mm in length, separated by a plurality of rows of continuous, relatively short fiber clumps 24, e.g., up to about 5 mm in length. Each of the tall fiber clumps include fibers 25 of variable height arranged so as to form a triangular-like spike 26. Likewise, each of the short fiber clumps have fibers 27 of variable height arranged in a form also of a triangular-like spike 28.

By this pattern, upon pressing the cleaning surface into contact with surface 1 to be cleaned, and moving the article along and against the surface, the relatively tall fiber clumps engage the generally low portions 2 of the surface, whereas the relatively short fiber clumps engage generally higher portions 3 of the surface so as to remove dirt and debris from the low to the high portions of the surface, respectively. As with the previous embodiment, selected portions of the tall and short fiber clumps, depending on the manner of operation, engage relatively even portions of the surface as well as generally medium height portions in order to insure coverage, as practicable, of the surface. This arrangement has been found particularly useful for loosening and removing dust and debris as well as cleaning residue, polishing, buffing or the like.

Alternatively or concurrently, with at least one column of the non-continuous, relatively tall fiber clumps, the clumps are interspersed with and separated by a corresponding column comprising a plurality of the continuous, relatively short fiber clumps. Preferably, the short fiber clumps also include fibers of variable height arranged so as to form triangular-like spikes.

Preferably, the fibers are made of suitable conventional materials, or are secured to the housing by conventional methods, such that the cleaning surface is generally non-shedding. For instance, the fibers may be constructed of natural materials, e.g., cotton strands, synthetic fibers, such as fine strands of one or more resilient, flexible polymeric materials such as polyethylene, Nylon®, or any combination thereof, whether of uniform or non-uniform diameter. In one embodiment, fibers or relatively thin bristles having a diameter approximating that of human hair are considered suitable for purposes of the present invention. As will be appreciated by those skilled in the art, fiber thickness and length may be varied depending upon the nature of the material, its elasticity and other factors, giving consideration to the purpose for which the present invention is intended.

In addition, it is preferred that the housing be a one piece, generally rigid or semi-rigid unit, either at least partially solid or including a hollow shell effectively sealed from the ingress (or egress) of fluids such as water or air. A one piece construction is advantageous for providing relatively simple, inexpensive manufacture that insures durability and prolongs article life. Each portion of the unit is preferably constructed of one or more polymeric materials such as polyethylene, e.g., HID 112 manufactured by Chevron Corporation. Alternatively or concurrently therewith, a housing construction of a conventional high-impact resistant plastic is also desirable for minimizing risk of damage if dropped. In addition, materials such as wood, a carbon fiber based material, metal, alloy, metallic substance or the like are considered suitable, within the spirit and scope of the present invention. As a further option, the housing may be constructed of a resilient or flexible material such as natural or synthetic sponge, without departing from the principles set forth herein.

Although the present invention has been shown and described as having a generally block-like rectangular structure, it is understood that the article, in general, and the housing, in particular, may take other forms, giving consideration to the purpose for which the present invention is intended. For instance, either portion may be circular in shape, have a kidney shape and/or be pointed at one or more sides or ends, be rectangular in shape with scores or indentations on the sides for accommodating the user's grip, or the like, within the spirit and scope of the present invention.

According to yet another embodiment, of which FIGS. 1-2B are representative, the cleaning surface 14 comprises, at least in part, the substantially flexible material 15 formed in multiple, alternating patterns. The patterns include at least one row of continuous, relatively tall teeth 16, e.g., up to about 15 mm, separated by a plurality of rows of continuous, relatively short teeth 17, e.g., up to about 5 mm. Alternatively or concurrently, in at least one column of the relatively tall teeth 16, the teeth are non-continuous, being interspersed with and separated by a corresponding column comprising a plurality of the continuous, relatively short teeth 17.

Upon pressing the cleaning surface into contact with a surface to be cleaned, and moving the article along and against surface 1, the relatively tall teeth engage the generally low portions 2 of the surface, and the relatively short teeth engage the generally higher portions 3 of the surface so as to remove dirt and debris from the low to the high portions of the surface, respectively. Again, selected portions of the tall and short teeth, depending on the manner of operation, engage relatively even portions of the surface as well as generally medium height portions in order to insure surface coverage, as practicable.

Referring now to another aspect of the present invention, of which FIGS. 3-4A are representative, the cleaning surface 20 includes a plurality of the relatively soft, thin, flexible, vertically disposed fibers. Desirably, the fibers are grouped in multiple, alternating patterns comprising at least one row of continuous, relatively tall fiber clumps 23, such as up to about 15 mm high, separated by a plurality of rows of continuous, relatively short fiber clumps 24, e.g., up to about 5 mm high. Each of the respective tall and short fiber clumps include fibers 25, 27, respectively, of variable height arranged so as to form a tooth 29.

Optionally, in at least one column of the relatively tall fiber clumps 23, the teeth are non-continuous, being interspersed with and separated by a corresponding column comprising a plurality of the continuous, relatively short fiber clumps 24. Upon pressing the cleaning surface into contact with a surface to be cleaned, and moving the article along and against the surface, the relatively tall fiber clumps engage generally low portions of the surface, and the relatively short fiber clumps engage generally higher portions of the surface so as to remove dirt and debris from the low to the high portions of the surface, respectively. As before, selected portions of the tall and short fiber clumps, depending on the manner of operation, engage relatively even portions of the surface as well as generally medium height portions in order to insure surface coverage, as practicable.

Figure 8:
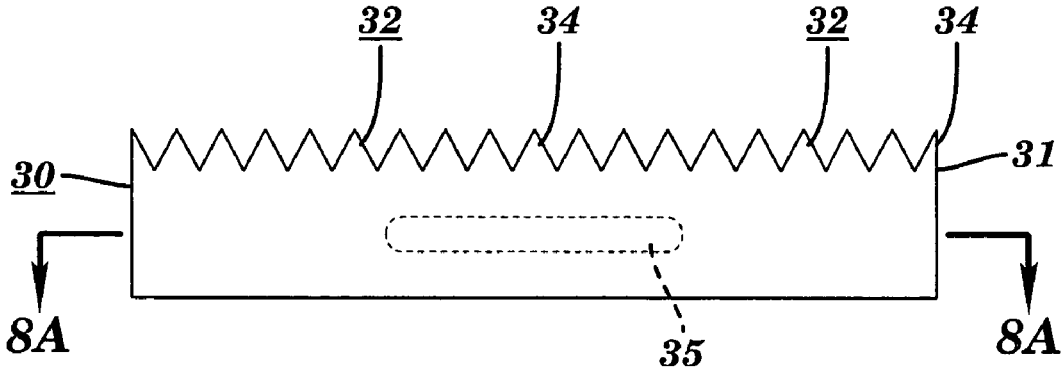
FIG. 8 is a side view of the article shown in FIG. 5, according to another embodiment of the present invention.

As shown in FIGS. 5-8, and in accordance with yet another aspect of the present invention, cleaning surface 30 is provided including a substantially flexible material 31 formed in rows of pyramid-like teeth 32. The teeth are relatively tall 33, e.g., again up to about 15 mm long, or, in the alternative, as shown in FIG. 8, are relatively short 34, such as up to about 5 mm in length, depending on the application desired. Upon grasping of the support by the user, pressing the cleaning surface into contact with a surface to be cleaned, and moving the article along and against the surface, the flexibility and configuration of the relatively tall teeth (or relatively short teeth or in any combination thereof) is such as to engage both relatively low portions of the surface and relatively high portions of the surface so as to remove dirt and debris from the low to the high portions of the surface.

Figure 9:
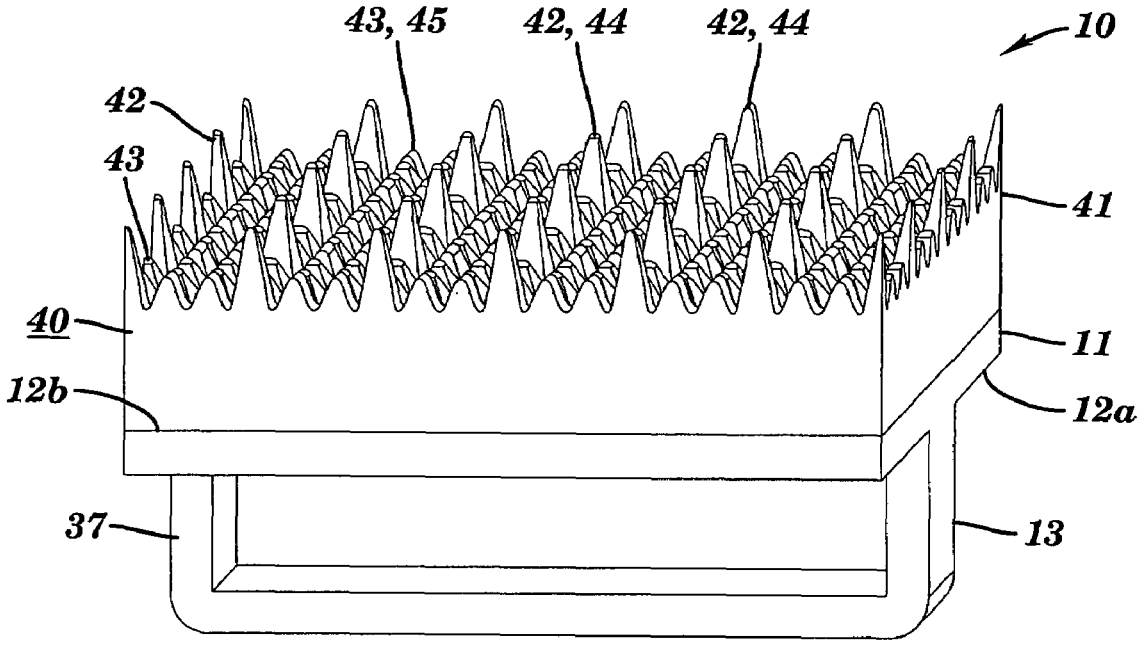
FIG. 9 is a perspective view of an article for cleaning uneven, variable geometry surfaces of electronic devices, internal electronic assemblies, or the like, in accordance with yet another embodiment of the present invention.
Figure 9A:
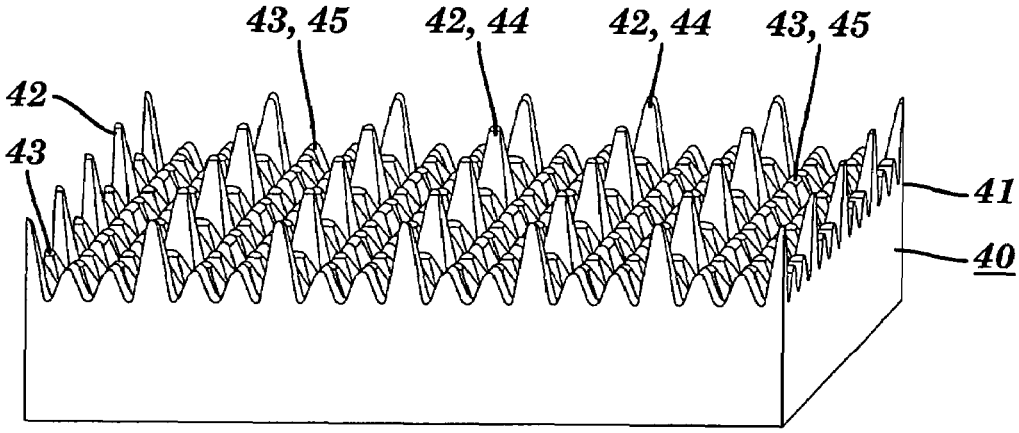
FIG. 9A is a detail perspective view of the article cleaning surface shown in FIG. 9.
Figure 10:
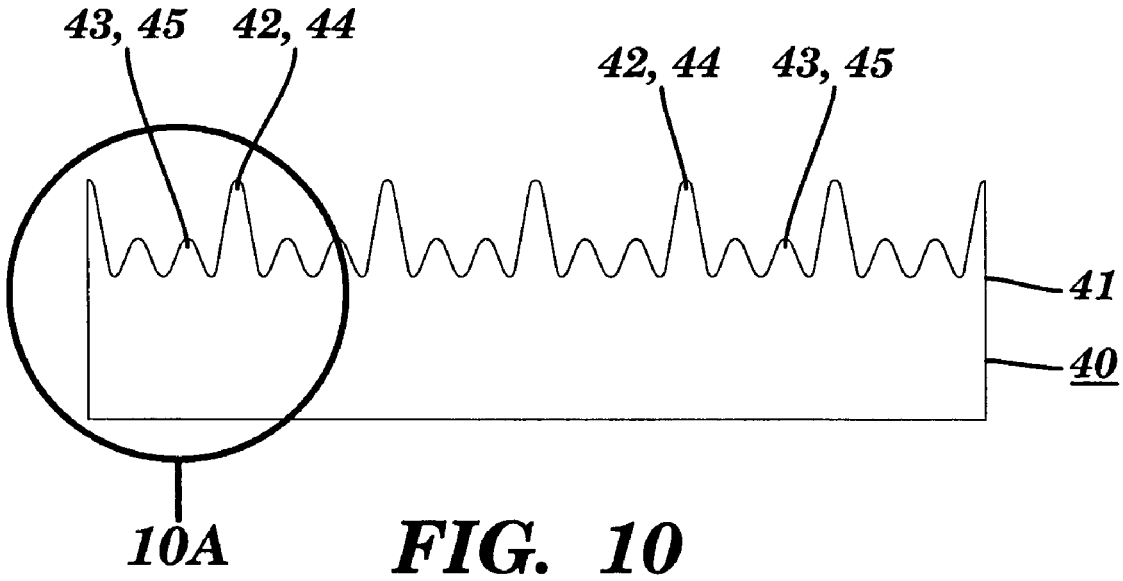
FIG. 10 is an side view of the article cleaning surface shown in FIG. 9.
Figure 10A:
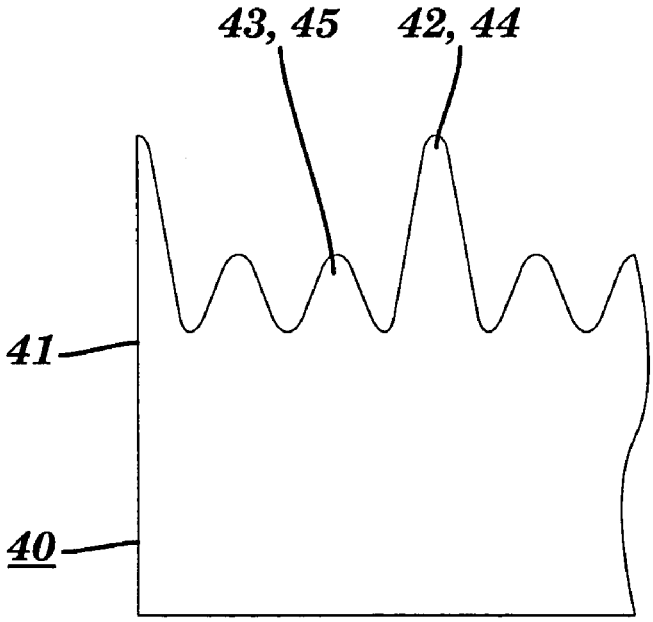
FIG. 10A is an enlarged cut-away view of the article set forth in FIG. 10 showing the tooth configuration, according to one aspect of the present invention.
Figure 11:
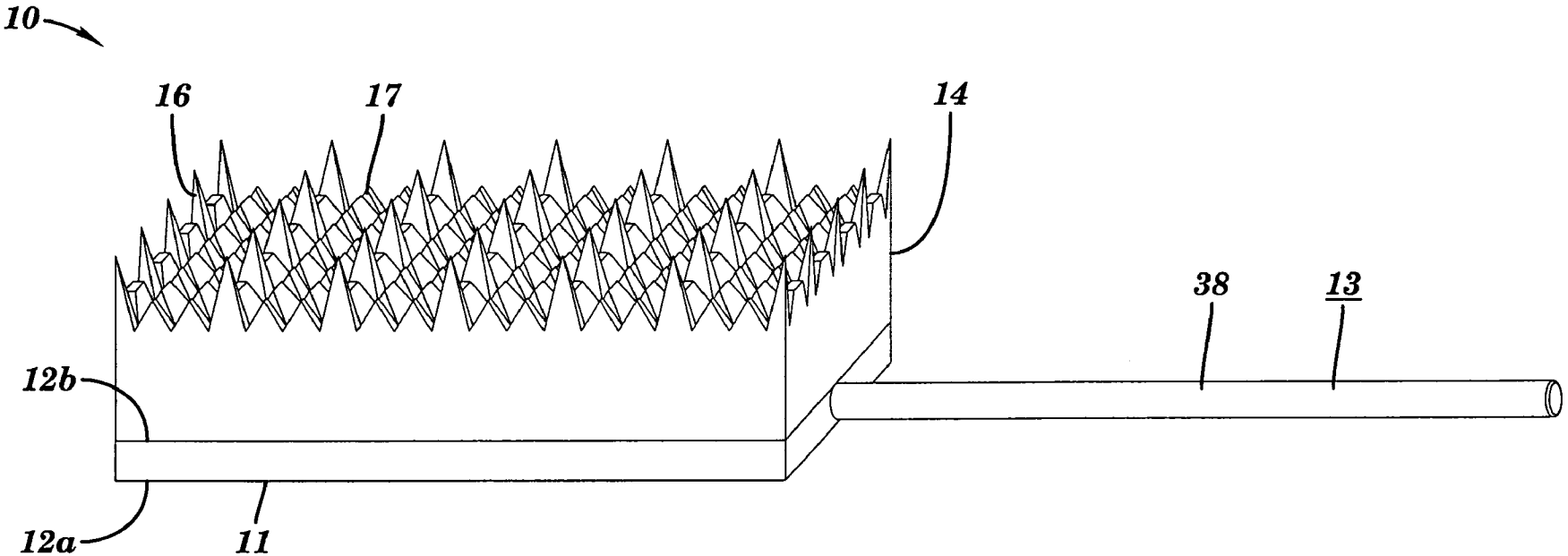
FIG. 11 is a perspective view of an article for cleaning uneven, variable geometry surfaces of electronic devices, internal electronic assemblies, or the like, according to still another aspect of the present invention.
Figure 13:
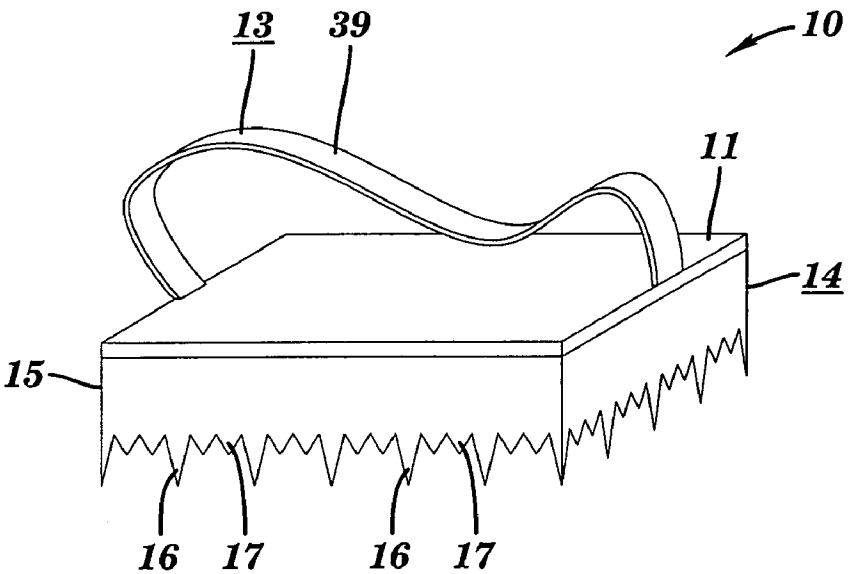
FIG. 13 is a detail perspective view of an article for cleaning uneven, variable geometry surfaces of electronic devices, internal electronic assemblies, or the like, according to a another aspect of the present invention.

As a further alternative, another cleaning surface configuration may be utilized, as illustrated generally in FIGS. 9-10A. In this arrangement, a cleaning surface 40 is provided that includes a substantially flexible material 41 formed in multiple, alternating patterns of relatively tall triangular-like spikes 42, for instance, up to about 15 mm, and relatively short triangular-like spikes 43, for instance, up to about 5 mm. According to yet another embodiment, the substantially flexible material is formed in multiple, alternating patterns of relatively tall teeth 44 and relatively short teeth 45, e.g., of like relative lengths as above. With either embodiment, upon pressing the cleaning surface into contact with a surface to be cleaned, and moving the article along and against the surface, the relatively tall triangular-like spikes 42 or teeth 44 engage generally low portions of the surface, whereas the relatively short triangular-like spikes 43 or teeth 45 engage generally higher portions of the surface so as to remove dirt and debris from the low to the high portions of the surface, respectively.

Whether using the embodiment of FIGS. 5-8 or that set forth in FIGS. 9-10A, selected portions of the tall and/or short spikes or teeth, depending on the manner of operation, engage relatively even portions of the surface as well as generally medium height portions in order to insure surface coverage, to the extent practicable.

While the present invention has been shown and described in connection with a flexible material such as ESD polyurethane, it is understood that other materials may be suitable, giving consideration to the purpose for which the present invention is intended. Other acceptable materials include, but are not limited to, other antistatic or conductive foam materials such as a closed-cell cross-linked polyethylene, ethylene copolymer, or polypropylene foam. The material may further include, in whole or in part, other polymeric sponge-like compositions, wool or cotton-based materials, as well as natural sponge, within the spirit and scope of the present invention.

By constructing the present invention in this fashion, namely, utilizing a rigid or semi-rigid housing in conjunction with a flexible cleaning surface material so configured, the invention provides and/or facilitates ready positioning of the article into generally perpendicular engagement with an imaginary plane corresponding to the uneven surface to be cleaned. Moreover, for ease of placement of the article in a desired orientation, the user may select any support appropriate to the application desired.

In one embodiment, as illustrated in FIGS. 1, 3 and 9, the support 13 is a relatively rigid handle 37 adapted for ready grasping by the user. In another embodiment, best seen in FIG. 11, the support takes the form of a rod or long handle 38 secured thereto using glue, friction fit, molding the handle therewith, or like conventional bonding method. With this arrangement, a housing of substantially reduced dimensions may be appropriate so that the user may take advantage of the length of the handle to clean difficult-to-reach surfaces of electronic devices. This arrangement, preferably in a miniaturized form, is also considered suitable for cleaning internal electronic assemblies.

With regard to internal electronic assemblies, care must be taken to insure that delicate surfaces characteristic of microelectronic media are not distorted or damaged during cleaning, antistatic treatment or the like. In this connection, use of the aforementioned cleaning solutions is considered generally less desirable, though deference is given to those skilled in the art as to the selection of any chemicals and/or practice of any methodology suitable for these applications. Further in this connection, it is, however, preferred that rod or handle 38 be constructed of a conductive material and that the article be utilized with proper grounding in order to eliminate the risk of static damage to sensitive electronic components.

Figure 12:
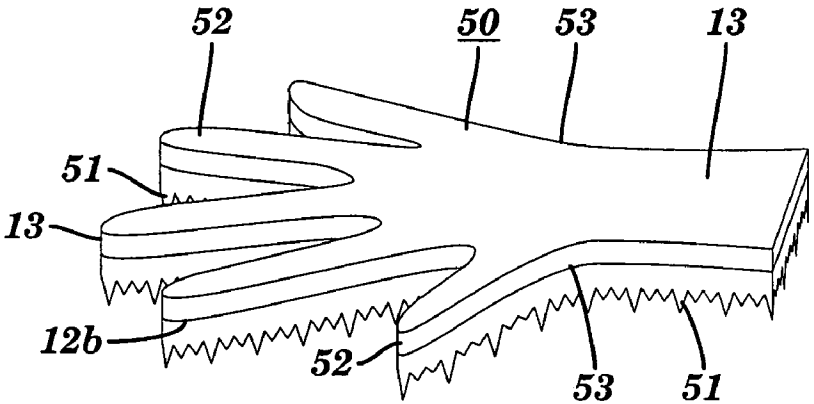
FIG. 12 is a detail perspective view of an article for cleaning uneven, variable geometry surfaces of electronic devices, internal electronic assemblies, or the like, according to a further aspect of the present invention.

According to still another embodiment, shown in FIG. 12, the article is formed as a glove and/or finger cot 50, a cleaning surface 51 being mounted to finger portions 52 and/or palm portions 53 thereof. This arrangement is considered particularly advantageous over conventional means for cleaning electronic devices. Moreover, as illustrated generally in FIGS. 5 and 13, the user may choose a flexible, elastic or semi-rigid strap 39, adjustable or non-adjustable, adapted for securing the housing to a user's hand for ease of use.

Figure 8A:
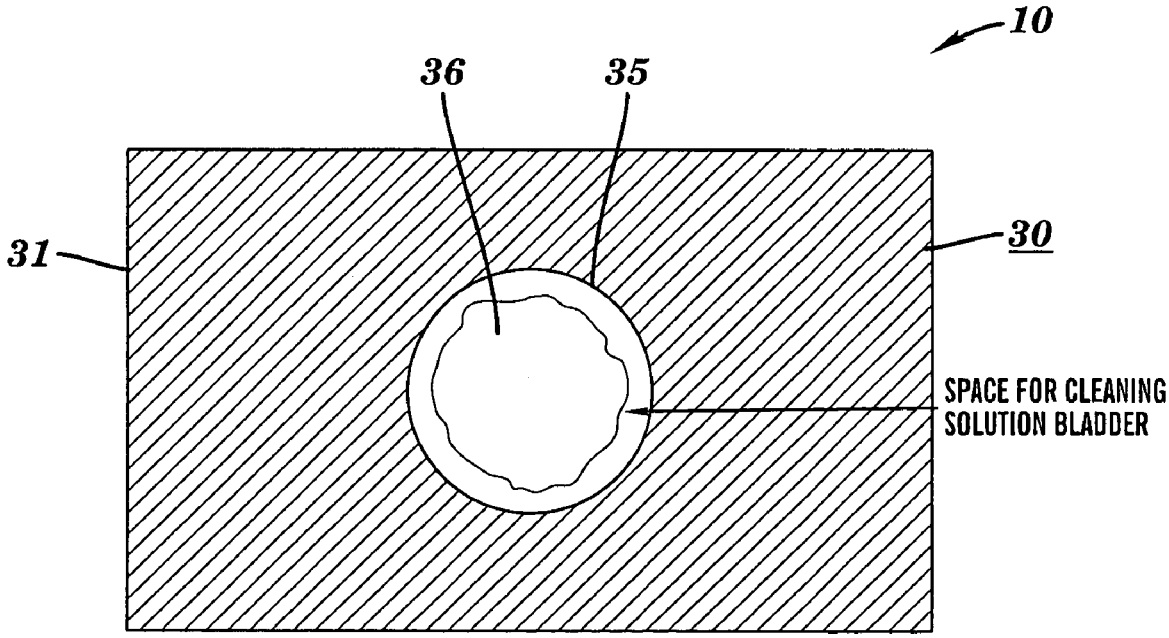
FIG. 8A is a sectional view taken along lines 5-5 of FIG. 8.

For enhanced cleaning effect, chemicals maybe utilized, in conjunction with or integrated with, the present invention. For example, as illustrated in FIGS. 8 and 8A, the housing is provided with a hollowed portion 35 for receiving and securing a reservoir, a breakable bladder, a sponge, or the like 36, filled with conventional cleaning solution; e.g., Windex®, Fantastic®, or other generally mild detergent; an antibacterial solution (bleach or non-bleach containing), e.g., benzalconium chloride, isopropyl alcohol or triclosan; an antistatic solution, e.g., sodium tripolyphosphate, trisodium phosphate and/or trisoium hydroxethyl ethylene diamine triacetate; and/or the like. Upon depressing the cleaning surface to a selected degree during application, pressure exerted by the surface upon the bladder or reservoir, for instance, cause the same to leaks or otherwise release a corresponding amount of solution. Alternatively or concurrently, such pressure causes-the bladder to break for a one-time release of the solution.

Such arrangements have also been found suitable for administering a paste, gel or solution comprising other selected compositions of ammonia, isopropyl alcohol, or the like to surfaces of electronic devices for cleaning, static neutralization and/or disinfection. Alternatively or concurrently, administration of these chemicals in a spray or like conventional method of impregnating the cleaning surface with such chemicals, or applying such chemicals thereto, is optional, as will be appreciated by those skilled in the art.

In still another embodiment, alternatively or concurrently with any of the foregoing cleaning surface arrangements, the cleaning surface is preferably configured for ready detachment and replacement by the user, the surface being detachably secured to the housing such as by conventional sliding engagement, snap fit, VELCRO® or the like, for ready removal or replacement. Accordingly, the cleaning surface may be readily unsnapped from the housing, removed and replaced with a new cleaning surface upon signs of worn material or fibers and/or decreased effectiveness. Also in this manner, the article may be converted from a unit that is generally more suitable for ready disposal to one that is reusable and/or more long lasting.

Turning now to use and operation, in accordance with the present invention, a method is provided for cleaning uneven, variable geometry surfaces of electronic devices. Initially, the support of the article is grasped by a user, the article comprising the housing having opposing faces with the support mounted to the first of the faces and the cleaning surface mounted to the second and opposite face of the housing. The cleaning surface includes a substantially flexible material formed in multiple, alternating patterns comprising at least one row of non-continuous, relatively tall teeth separated by a plurality of rows of continuous, relatively short teeth. Next, the cleaning surface of the article is pressed into contact with a surface to be cleaned. The article is then moved along and against the surface, preferably in a back and forth and/or to and fro motion, the relatively tall teeth engaging generally low portions of the surface, and the relatively short teeth engaging generally higher portions of the surface so as to remove dirt and debris from the low to the high portions of the surface, respectively.

According to another aspect of the present invention, a method is provided for cleaning uneven, variable geometry surfaces of electronic devices in which the cleaning surface includes the plurality of clumps of relatively soft, thin, flexible, vertically disposed fibers, the fibers being grouped in multiple, alternating patterns comprising at least one row of the non-continuous, relatively tall fiber clumps, each of the tall fiber clumps including the fibers of variable height arranged in the form a tooth and the tall fiber clumps being separated by the plurality of rows of continuous, relatively short fiber clumps, each of the short fiber clumps including the fibers of variable height arranged so as to likewise form a tooth. Once the user has grasped the support, the cleaning surface of the article is pressed into contact with a surface to be cleaned, and article is moved along and against the surface. In this connection, the relatively tall fiber clumps engage generally low portions of the surface, and the relatively short fiber clumps engage generally higher portions of the surface so as to remove dirt and debris from the low to the high portions of the surface, respectively.

According to another aspect of the present invention, a method for cleaning uneven, variable geometry surfaces of electronic devices is performed with the cleaning surface having a substantially flexible material formed in multiple, alternating patterns, as described as the various embodiments above, of relatively tall triangular-like spikes and relatively short triangular-like spikes. After the support has been grasped by the user, the cleaning surface of the article is pressed into contact with a surface to be cleaned. The article is then moved along and against the surface, the relatively tall triangular-like spikes engaging generally low portions of the surface, and the relatively short triangular-like spikes engaging generally higher portions of the surface so as to remove dirt and debris from the low to the high portions of the surface, respectively.

According to a still further aspect of the present invention, a method is practiced whereby the cleaning surface includes a substantially flexible material formed in rows of pyramid-like teeth. After the support has been grasped by the user, the cleaning surface of the article is pressed into contact with a surface to be cleaned. The article is then moved along and against the surface, the flexibility and configuration of the teeth being such as to engage both relatively low portions of the surface and relatively high portions of the surface so as to remove dirt and debris from the low to the high portions of the surface.

It is noted that, with respect to the various method embodiments set forth herein, relatively moderate to relatively high pressure on surfaces of electronic devices is considered unacceptable as it can lead to scratches from foreign bodies and surface abrasion as well as excess wear and tear on the cleaning surface and other components of the article.

Generally speaking, cleaning surface flexibility, geometry and chemistry are considered relatively important for effective cleaning of electronic devices or the like, according to the various aspects of the present invention. Since the dimensions of the teeth, spikes or the like used on the cleaning surface are relatively small, e.g., between about 5 mm and about 15 mm, their relatively narrow peak allows more pressure to be applied more uniformly to the surface without damage. Using a conventional back and forth motion, the degree of friction is sufficient for debris removal and has been found well below the threshold of abrasion for polymerics and other materials normally used in the construction of electronic devices. Hence, the present invention provides an optimum combination of speed, flexibility, geometry and chemistry for maximum cleaning of uneven, variable geometry surfaces without damage to the surfaces.

Optimal use and comfort of the present invention is further facilitated by the uniquely shaped and sized support, strap or handle. This feature not only fits the contour of a wide range of user hands, but also serves to guide the user to an appropriate grip and orientation for optimal use. Moreover, it provides a compact, practical geometry for greater versatility.

Although the present invention has been shown and described with reference to a size relative to the user's hand, those skilled in the art will appreciate that article size may be considerably smaller or substantially larger, within the spirit and scope of the present invention, giving consideration to the particular application desired. As an example, for cleaning large surface areas with deep crevices and tall peaks, a proportionately large cleaning surface with some spikes, teeth, or fiber clumps much longer than 15 mm and others considerably shorter than 5 mm. At the other end of the spectrum, for purposes of cleaning very small (or extremely small) surfaces such as those of internal electronic assemblies, microelectronic assemblies, and other bare electronics, an article of correspondingly small and complementary dimensions can be constructed and implemented, in accordance with the present invention as set forth herein.

Overall, the present invention facilitates superior cleaning, static neutralization and/or disinfection of uneven, variable geometry surfaces without damage. The articles and methods described are uniquely and specially tailored for manual cleaning uneven, variable geometry surfaces of electronic devices, internal electronic assemblies or the like. The article is practical, easy to use and reliable, having a design life considerably longer than that of a traditional brushes, sponges, rags and wipes. It is also beneficial for its durability, easy storage and being safe for virtually any exterior surface of electronic devices, internal electronic assemblies or the like. The article may be readily shaped and sized to fit any user's hand for ready maneuverability and easily miniaturized for cleaning tiny, fragile surfaces such as those of microelectronics for effectively cleaning such surfaces with minimal skill and vigilance of the user.

Moreover, the article is preferably constructed of lightweight, low cost materials, is quiet and efficient in operation, and is readily adaptable for use with or without specialized chemicals for enhanced cleaning, disinfection and/or antistatic treatment. The article's relatively low cost makes it economically feasible as a relatively small, low cost, consumer item, or as low cost, reusable commercial or industrial tool, whose durability, effectiveness and practicality are considered unparalleled.

The novel cleaning surface configuration utilizes variable levels of fibers, bristles, flexible teeth and/or other specially configured arrangements adapted for cleaning different height surfaces, irregularly shaped surfaces and for penetrating grooves, crevices or the like. More or less concurrently therewith, it provides gentle brushing, rubbing and/or scouring action for optimum cleaning effect that is better adapted for cleaning the uneven, variable geometry surfaces than conventional wipes and rags, exhibits superior scouring to that provided by sponges and pressurized air, larger and faster to use than swabs, and provides a softer and more versatile cleaning surface than conventional brushes as well as gentle brushing action without cleaning surface abrasion or shedding. These benefits are accomplished without the expense and impracticality of batteries, power adapters and re-chargers.

The present invention is especially advantageous in providing fast, effective cleaning, disinfection, purification and/or antistatic effect to virtually any surface geometry, whether characterized by rounded or squared surfaces, peaks and valleys, cracks and crevices or the like. It is particularly well-suited for providing gentle but effective cleaning of surfaces of electronic devices, including, but not limited to, computer keyboards, computer mice, track-balls, remote controls, joysticks, game controllers, and other computer pointing devices, ventilation grills, display screens, laptops, personal digital assistants, cellular phones, microphones, telephones, blackberry's and the like. The invention is likewise considered beneficial for cleaning surfaces of internal electronic assemblies, including, but not limited to, printed circuit boards, microprocessors and the like, within the spirit and scope of the present invention.

Various modifications and alterations to the present invention may be appreciated based on a review of this disclosure. These changes and additions are intended to be within the scope and spirit of this invention as defined by the following claims.

What is claimed is:

1. An article for cleaning uneven, variable geometry surfaces of electronic devices, the article comprising a housing having opposing faces with a support mounted to a first of the faces and a cleaning surface mounted to a second and opposite face of the housing, the article further comprising a first, relatively longer side and a second relatively shorter side, the longer side defining a longitudinal axis and the shorter side a lateral axis, each side being at least tangential to the respective axis defined, the cleaning surface including a substantially flexible material formed in multiple, alternating patterns comprising a plurality of rows of non-continuous, relatively tall pyramidal shapes separated by a plurality of rows of continuous, relatively short pyramidal shapes, the patterns extending along the entire length of the article along the longitudinal axis, the respective rows of non-continuous relatively tall pyramidal shapes and continuous, relatively short pyramidal shapes being generally parallel to the longitudinal axis, at least one of the rows of non-continuous, relatively tall pyramidal shapes being flanked on each side by at least one of the rows of continuous, relatively short pyramidal shapes, such that, upon grasping of the support by a user, pressing the cleaning surface into contact with a surface to be cleaned, and moving the article along and against the surface, the relatively tall pyramidal shapes engage generally low portions of the surface, whereas the relatively short pyramidal shapes engage generally higher portions of the surface so as to remove dirt and debris from the low to the high portions of the surface, respectively.

2. The article set forth in claim 1 wherein the housing is constructed, at least in part, of a generally rigid material.

3. The article set forth in claim 1 wherein the housing is constructed, at least in part, of a semi-rigid material.

4. The article set forth in claim 1 wherein the housing is constructed, at least in part, of a flexible material.

5. The article set forth in claim 1 wherein the flexible material is ESD polyurethane.

6. The article set forth in claim 1 wherein the support is a graspable scored handle.

7. The article set forth in claim 1 wherein the support is a graspable strap.

8. The article set forth in claim 1 wherein the support is a graspable rod.

9. The article set forth in claim 1 wherein the cleaning surface is treated with an anti-static composition.

10. The article set forth in claim 1 wherein the cleaning surface is treated with a cleaning composition.

11. The article set forth in claim 1 wherein the cleaning surface is treated with an anti-bacterial composition.

12. An article for cleaning uneven, variable geometry surfaces of electronic devices, the article comprising a housing having opposing faces with a support mounted to a first of the faces and a cleaning surface mounted to a second and opposite face of the housing, the article further comprising a first, relatively longer side and a second relatively shorter side, the longer side defining a longitudinal axis and the shorter side a lateral axis, each side being at least tangential to the respective axis defined, the cleaning surface including a substantially flexible material formed in multiple, alternating patterns comprising a plurality of rows of non-continuous, relatively tall pyramidal shapes separated by a plurality of rows of continuous, relatively short pyramidal shapes, the patterns extending along the entire length of the article along the longitudinal axis, the respective rows of non-continuous relatively tall pyramidal shapes and continuous, relatively short pyramidal shapes being generally parallel to the longitudinal axis, and the adjacent rows of pyramidal shapes forming corresponding adjacent columns of the pyramidal shapes generally perpendicular to and interspersed with the rows wherein at least one column of the non-continuous, relatively tall, pyramidal shapes are interspersed with and separated by a corresponding column comprising a plurality of continuous, relatively short pyramidal shapes, at least one of the rows of non-continuous, relatively tall pyramidal shapes being flanked on each side by at least one of the rows of continuous, relatively short pyramidal shapes such that, upon grasping of the support by a user, pressing the cleaning surface into contact with a surface to be cleaned, and moving the article along and against the surface, the relatively tall pyramidal shapes engage generally low portions of the surface, whereas the relatively short pyramidal shapes engage generally higher portions of the surface so as to remove dirt and debris from the low to the high portions of the surface, respectively.

13. An article for cleaning uneven, variable geometry surfaces of electronic devices, the article comprising a base having opposing faces with a handle mounted to a first of the faces and a cleaning surface mounted to a second and opposite face of the base, the article further comprising a first, relatively longer side and a second relatively shorter side, the longer side defining a longitudinal axis and the shorter side a lateral axis, each side being at least tangential to the respective axis defined, the cleaning surface including a substantially flexible material formed in multiple, alternating patterns comprising a plurality of rows of non-continuous, relatively tall pyramidal teeth separated by a plurality of rows of continuous, relatively short pyramidal teeth, the patterns extending along the entire length of the article along the longitudinal axis, the respective rows of non-continuous relatively tall pyramidal teeth and continuous, relatively short pyramidal teeth being generally parallel to the longitudinal axis, and the adjacent rows of pyramidal teeth forming corresponding adjacent columns of the pyramidal teeth generally perpendicular to and interspersed with the rows, wherein the columns of non-continuous, relatively tall pyramidal teeth are interspersed with and separated each by a corresponding column comprising a plurality of continuous, relatively short pyramidal teeth, at least one of the rows of non-continuous, relatively tall pyramidal shapes being flanked on each side by at least one of the rows of continuous, relatively short pyramidal shapes, such that, upon grasping of the handle by a user, pressing the cleaning surface into contact with a surface to be cleaned, and moving the article along and against the surface, the relatively tall pyramidal teeth engage generally low portions of the surface, whereas the relatively short pyramidal teeth engage generally higher portions of the surface so as to remove dirt and debris from the low to the high portions of the surface, respectively.

14. An article for cleaning uneven, variable geometry surfaces of electronic devices, the article comprising a housing having opposing faces with a support mounted to a first of the faces and a cleaning surface mounted to a second and opposite face of the housing, the article further comprising a first, relatively longer side and a second relatively shorter side, the longer side defining a longitudinal axis and the shorter side a lateral axis, each side being at least tangential to the respective axis defined, the cleaning surface including a substantially flexible material formed in a plurality of rows of variable height pyramidal teeth in alternating patterns comprising a plurality of rows of non-continuous, relatively tall pyramidal teeth separated by a plurality of rows of continuous, relatively short pyramidal teeth, the patterns extending along the entire length of the article along the longitudinal axis, the respective rows of non-continuous relatively tall pyramidal teeth and continuous, relatively short pyramidal teeth being generally parallel to the longitudinal axis, and the adjacent rows of pyramidal teeth forming corresponding adjacent columns of the pyramidal teeth generally perpendicular to and interspersed with the rows, wherein the columns of non-continuous, relatively tall pyramidal teeth are interspersed with and separated by a corresponding column comprising a plurality of continuous, relatively short pyramidal teeth, at least one of the rows of non-continuous, relatively tall pyramidal teeth being flanked on each side by at least one of the rows of continuous, relatively short pyramidal teeth, such that, upon grasping of the support by a user, pressing the cleaning surface into contact with a surface having relatively high and relatively low portions to be cleaned, and moving the article along and against the surface, the flexibility and configuration of the pyramidal teeth is such as to engage both the relatively low portions of the surface and the relatively high portions of the surface so as to remove dirt and debris from the low to the high portions of the surface.

15. The article set forth in claim 14 wherein the housing is constructed, at least in part, of a generally rigid material.

16. The article set forth in claim 14 wherein the housing is constructed, at least in part, of a semi-rigid material.

17. The article set forth in claim 14 wherein the housing is constructed, at least in part, of a flexible material.

18. The article set forth in claim 14 wherein the flexible material is ESD polyurethane.

19. The article set forth in claim 14 wherein the support is a scored handle for grasping by the user.

20. The article set forth in claim 14 wherein the support is a strap for grasping by the user.

21. The article set forth in claim 14 wherein the support is a rod for grasping by the user.

22. The article set forth in claim 14 wherein the cleaning surface is treated with an anti-static composition.

23. The article set forth in claim 14 wherein the cleaning surface is treated with a cleaning composition.

24. The article set forth in claim 14 wherein the cleaning surface is treated with an anti-bacterial composition.

* * * * *